US008528624B2

(12) United States Patent
Svensson et al.

(10) Patent No.: US 8,528,624 B2
(45) Date of Patent: Sep. 10, 2013

(54) MOULD AND A METHOD OF COMPOSITE CASTING OF A ONE PIECE CAST TOOL

(75) Inventors: Christer Svensson, Karlshamn (SE); Tomas Nilsson, Katrineholm (SE)

(73) Assignee: Verktygs Allians i Hässleholm AB, Hässleholm (SE)

( * ) Notice: Subject to any disclaimer, the term of this patent is extended or adjusted under 35 U.S.C. 154(b) by 42 days.

(21) Appl. No.: 12/920,889

(22) PCT Filed: Mar. 5, 2009

(86) PCT No.: PCT/SE2009/000124

§ 371 (c)(1),
(2), (4) Date: Nov. 15, 2010

(87) PCT Pub. No.: WO2009/110832

PCT Pub. Date: Sep. 11, 2009

(65) Prior Publication Data

US 2011/0185857 A1 Aug. 4, 2011

(30) Foreign Application Priority Data

Mar. 6, 2008 (SE) ..... 0800522

(51) Int. Cl.
*B22D 19/06* (2006.01)
*B22C 9/00* (2006.01)

(52) U.S. Cl.
USPC ..... 164/91; 164/271

(58) Field of Classification Search
USPC ..... 164/6, 34, 45, 91, 94, 95, 98, 271
See application file for complete search history.

(56) References Cited

FOREIGN PATENT DOCUMENTS

| | | | |
|---|---|---|---|
| DE | 806037 C | | 6/1951 |
| GB | 1516312 A | | 5/1978 |
| JP | 55-81061 A | * | 6/1980 |
| WO | 03041895 A1 | | 5/2003 |

OTHER PUBLICATIONS

International Search Report for corresponding International App. PCT/SE2009/000124, mailed Jul. 2, 2009.
JP3189065 A, Takagi Chuko KK, Sep. 19, 1991 (abstract).
JP 57025276 A, Nissan Motor Co. Ltd., Feb. 10, 1982 (abstract).
JP 10156515 A, Toshiba Mach. Co. Ltd., Jun. 16, 1998 (abstract).
JP 2004255424 A, Asai Takashi, Sep. 16, 2004 (abstract).

* cited by examiner

*Primary Examiner* — Kevin P Kerns
(74) *Attorney, Agent, or Firm* — WRB-IP LLP

(57) ABSTRACT

A mould for one piece casting of a tool, which has a working component of steel and a body of grey iron has a first mould cavity section for the steel and a second mould cavity section for the grey iron, with an interconnection zone therebetween. A dividing plane between the sections is planar and horizontal and located at the interconnection zone. A duct leads from the first section to an accommodation space for possible surplus of steel. In a method for one piece casting of a tool, which has a working component of steel and a body of grey iron with an interconnection zone therebetween, the steel is cast in a first mould cavity section and the grey iron in a second mould cavity section. A dividing plane between the mould cavity sections is planar and horizontal. An accommodation space for surplus of steel is provided to permit steel to flow from the first mould cavity section at the level of the dividing plane into the accommodation space.

7 Claims, 6 Drawing Sheets

MOULD AND A METHOD OF COMPOSITE CASTING OF A ONE PIECE CAST TOOL

BACKGROUND AND SUMMARY

The present invention relates to a mould for composite casting of a one piece-cast tool, which comprises at least a first portion which includes the working component of the tool and which is manufactured from steel, and a second portion, which includes the body portion of the tool and which is manufactured from grey iron, the tool having at least a first mould cavity section for the steel and a second mould cavity section for the cast iron and there being at least one interconnection zone between the steel and the cast iron.

The present invention also relates to a method of composite casting of a one piece-cast tool, which comprises at least a first portion which includes the working component of the tool and which is manufactured from steel, a second portion which includes the body component of the tool and which is manufactured from grey iron, the first portion being cast in at least one first mould cavity section and the second portion being cast in a second mould cavity section of the mould.

In the production of tools for sheet metal working, for example pressing, cutting and similar working operations, it has been previous practice to separately produce a tool body which has then been provided with one or more working components, i.e. that component of components which carry out the actual working operation. The production of the tool body can be put into effect by casting of grey iron or by welding taking as starting material suitably dimensioned sheet metal material with adapted material composition.

In the alternative involving a cast tool body, heat treatment is often required of the tool body after the casting, this is followed by machining in order for requisite seats, holes for guide shafts and bolts for securing the working component or working components, but also to make possible securing of the tool in a machine.

In the production of the working component or components which are intended for carrying out the working operations for which the tool is designed and constructed, the point of departure has often been bar material, in which event the working components have machined to the correct configuration, provided with apertures for fixing bolts, guide shafts and the like. This has been followed by heat treatment and additional machining, for example grinding.

To produce tool in the above-outlined manner is extremely time-consuming and expensive and is therefore often determinative of the time consumption which is required for producing new products.

It is also previously known in the art to composite cast a tool in one continuous piece, where the tool has at least one working component manufactured from steel and a body component manufactured from grey iron. Such a tool and a method for its manufacture are described in WO 03/041895.

According to this publication, both the steel and the grey iron are cast in one and the same mould, an interconnection zone being formed in the interface region between these two materials.

Using the technology as disclosed in WO 03/041895, serious difficulties have been encountered in correctly localising the interconnection zone which is created between the steel and the grey iron. This may have as a consequence that the interconnection zone is positioned in such portions of the tool where, for example, major surface area differences occur, which occasions considerable problems in mechanical strength: Problems also occur if the interconnection zone arrives in such positions where major temperature differences occur, since such differences greatly affect the quality of the interconnection zone.

It is desirable to design the mould and the method intimated by way of introduction such that the drawbacks in the prior art technology are obviated. Thus, it is desirable to make it possible, in an accurate manner, to localise the interconnection zone which is formed between the steel and the grey iron so that, with great reliability, this is at the correct position and will have a controllable temperature over as great a part of its surface as possible. In addition, it is desirable to minimise the amount of steel employed.

According to an aspect of the present invention, a mould has a dividing plane between the first and the second mould sections is substantially planar and, in the position of use of the mould, substantially horizontal and located at the intended position for the interconnection zone, that, from the first mould cavity section there leads at least one runner or duct to at least one accommodation space for possible surplus of steel and that a lower defining surface to this duct, at the discharge of the duct to the first mould cavity section in the vertical direction is located on substantially the same level as the dividing plane.

According to an aspect of the present invention, a method is characterised in that a dividing plane between the first mould cavity section and the second mould cavity section is formed to be substantially planar and positioned substantially horizontally, but at least one accommodation space is provided in the mould and that possible surplus of steel is permitted to flow from the first mould cavity section at the level of the dividing plane into the accommodation space.

BRIEF DESCRIPTION OF THE ACCOMPANYING DRAWINGS

The present invention will now be described in greater detail hereinbelow, with reference to the accompanying Drawings. In the accompanying Drawings.

DETAILED DESCRIPTION

Figure 1:
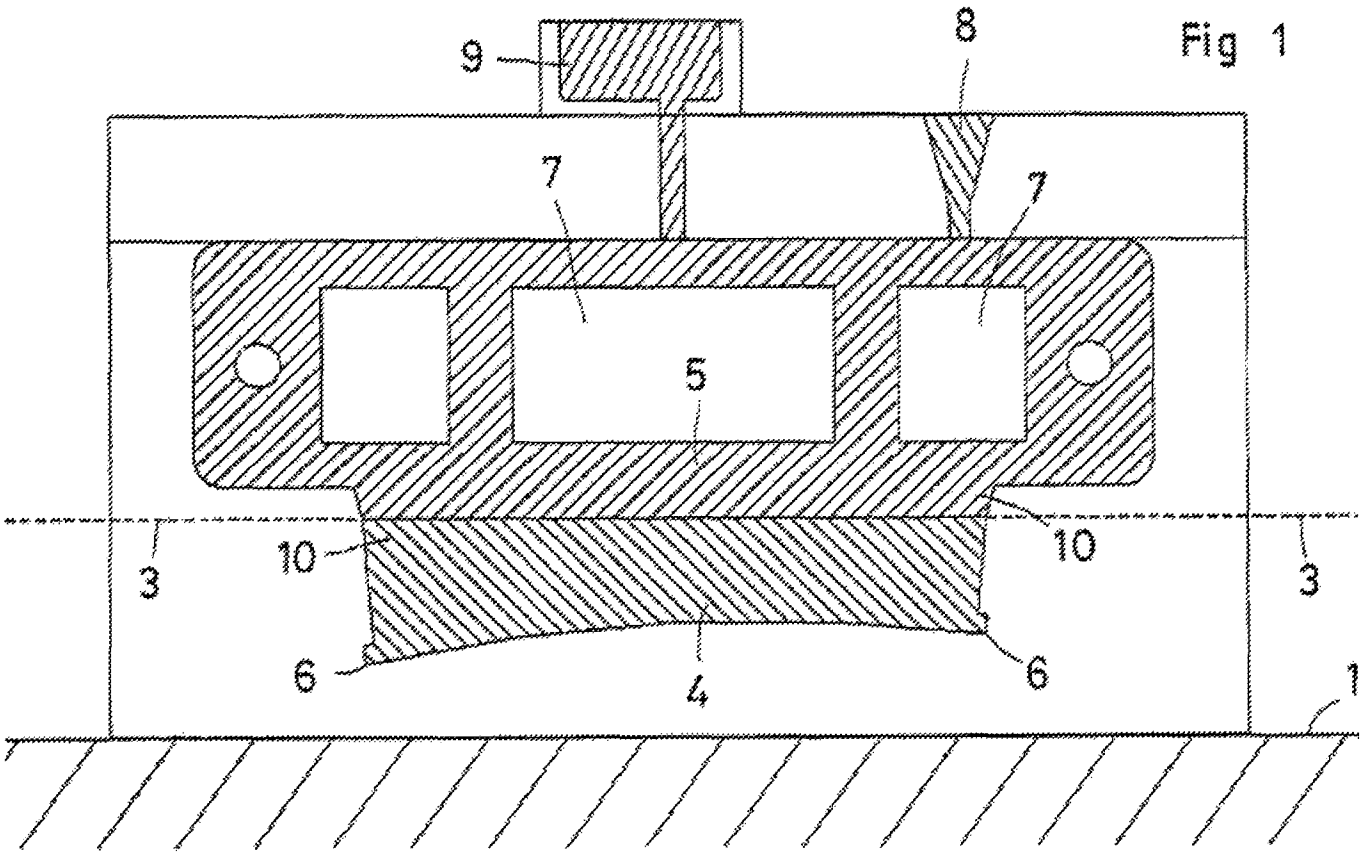
FIG. 1 is a schematic cross section through a mould formed according to the present invention.

In FIG. 1, reference numeral 1 relates to a substrate on which a schematically illustrated casting box or flask is positioned. The broken line 3 illustrates a dividing plane between a first mould cavity section 4 in the mould and a second cavity section 5 therein. The first mould cavity section 4 is intended for the casting of steel, which is to constitute a working component in the tool which is produced in the mould. The second mould cavity section 5 is intended for the casting of grey iron, which is to form a body component for the tool which is cast in the mould. The broken line 3 illustrates the dividing plane between the two materials and it should be emphasised that this dividing plane must be parallel with the substrate, which should both be horizontal and at least as close to horizontal as is humanly possible.

The term working component is taken to signify in this context the component or components of a tool which are intended for carrying out the actual working operations for which the tool is designed. The number of working components may vary from one tool to another.

The term body component is taken to signify in this context a body for the tool, the body being intended to support the working component or components and to serve for securing the tool in a machine.

In FIG. 1, reference numeral 6 relates, for example, to a cutting edge on the working component 4, while reference numeral 7 may illustrate a cavity in the body component 5. The cavity is realised in a conventional manner by the positioning of mould cores in the mould.

Reference numeral 8 refers to an ingate or sprue for the steel, while reference numeral 9 illustrates an ingate or sprue for the grey iron. It should be emphasised that the ingate system for the steel has portions which extend down under the first mould cavity section 4 and which discharge from beneath and up therein so that the casting operation always takes place in this direction.

The above disclosures imply that, on casting of the steel, the level of its upper surface will gradually move upwards in a direction towards the dividing plane 3, which represents the desired position of the interconnection zone between the steel and the grey iron. If the steel were to pass the imaginary interconnection zone 3 it will readily be perceived that steel would wind up in the second mould cavity section 5 which is intended for the grey iron. The result would be an excessively great consumption of steel, but also considerable quality problems in the interconnection zone between the two materials.

Figure 4:
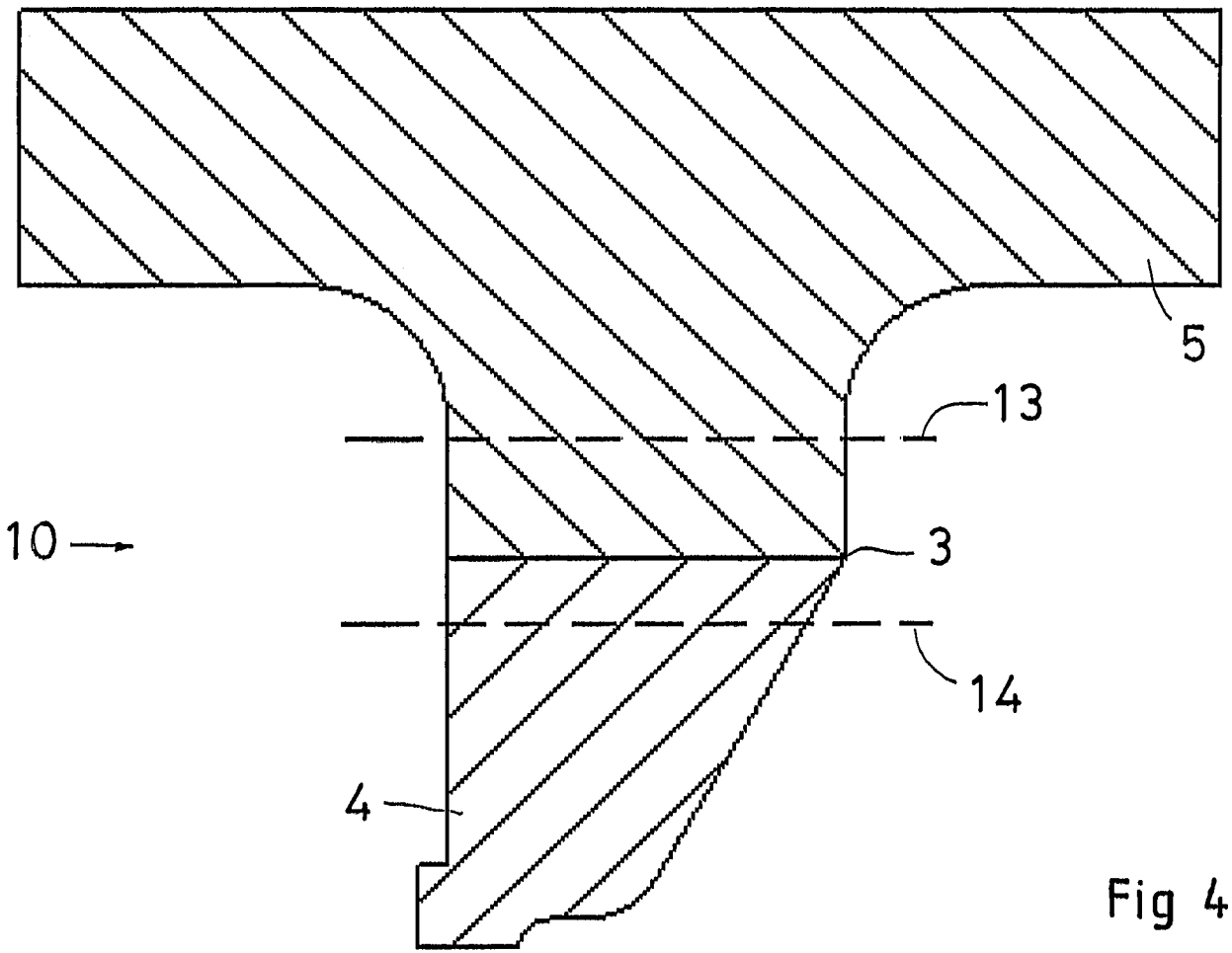
FIG. 4 is a cross section through a part of a model employed in the tool according to the present invention.

It will be apparent from FIG. 4 that the interconnection zone 3 between the steel in the first portion 4 of the tool and the grey iron in its second portion 5 is located in an evenly thick and vertically directed wall 10. By such means, abrupt area differences in or in the proximity of the contemplated interconnection zone will be avoided.

With the present invention correctly reduced into practice, the interconnection zone will have a thickness of 1-2.5 mm.

In casting according to the present invention, a first part of the casting model, which represents the first mould cavity section 4, thus the part where the steel is to be cast is weighed. Since the density of the material in the model is known, it is possible to compute a relatively accurate value of the quantity of the steel which is required to fill out the first mould cavity section 4.

However, there are inaccuracies in both material quality, dimensional accuracy, but perhaps above all the accuracy of the scales which measure the weight of the steel melt. This implies taken as a whole that the above-mentioned measures are insufficient to guarantee that the interconnection zone will arrive at the intended vertical position according to the dividing plane 3.

According to the present invention, use is made of one or more accommodation spaces 11 (see FIG. 2), the accommodation space 11 having a connection duct 12 whose lower edge discharges at the theoretical dividing plane 3. This implies that if too much steel were to be cast into the first mould cavity section 4, the surplus may depart at the theoretical dividing plane 3 via the connection duct 12 to the accommodation space 11. The volume of the accommodation space/accommodation spaces employed is adapted in such a manner that it is reliably sufficient to compensate for error sources which may be found in the calculation of the requisite steel quantity.

The connecting duct 12 is to have a minimum height of 20 mm and a minimum cross sectional area which is 1.5 times the cross sectional area of the ingate system via which the steel is supplied to the first mould cavity section 4. Further, the lower defining surface of the connection duct 12 must slant downwards in a direction in towards the accommodation space 11.

Figure 2:
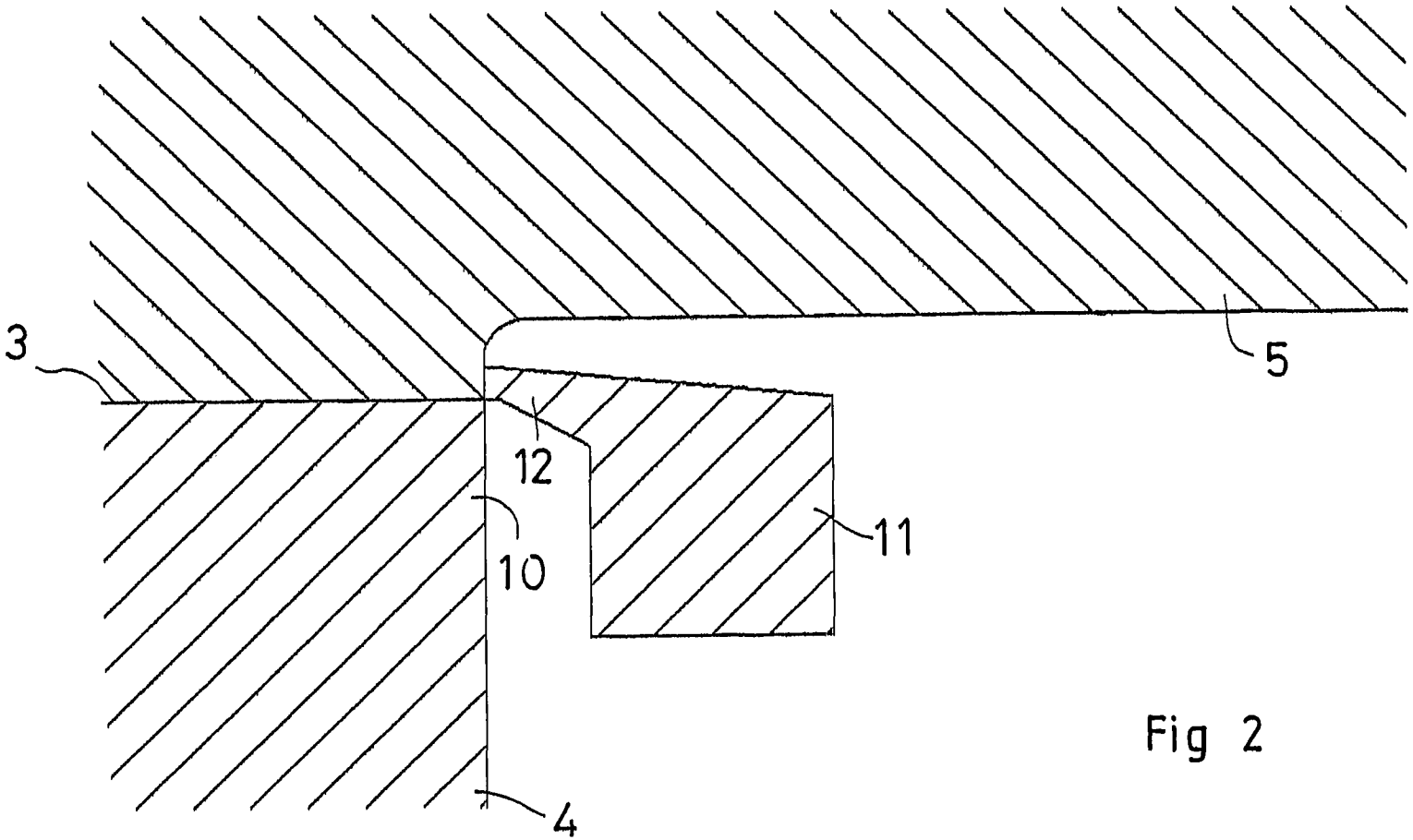
FIG. 2 is a detailed section through a mould in the region of an accommodation space for any possible surplus of steel.

If the grey iron section of the tool, i.e. that part which is cast in the second mould cavity section 5, has an appearance which is apparent from FIGS. 2 and 4, it is important that the distance between the contemplated dividing plane 3 and the underside of the grey iron portion is at least 50 mm since otherwise the mould above the accommodation space 11 would have excessively poorer mechanical strength. This distance coincides with a minimum suitable width of the interconnection zone.

In the foregoing, it was mentioned that the theoretical interconnection zone is to be positioned in the uniformly thick and vertically directed wall 10. This may have a thickness, thus in a direction from left to right in FIG. 4, in the order of magnitude of between 50 and 150 mm. In particular in thinner wall thicknesses, even a very small volume deviation of the steel would have a large height difference as a result in the actual level of the interconnection zone. Those tolerances which can be accepted in the above disclosed dimensions are an upward tolerance of approx. 20 mm according to the line 13 and a tolerance downwards of approx. 10 mm according to the line 14.

It will be apparent from FIG. 1 that the working component, i.e. that part of the tool which is manufactured from steel, may have an elongate configuration.

Figure 3:
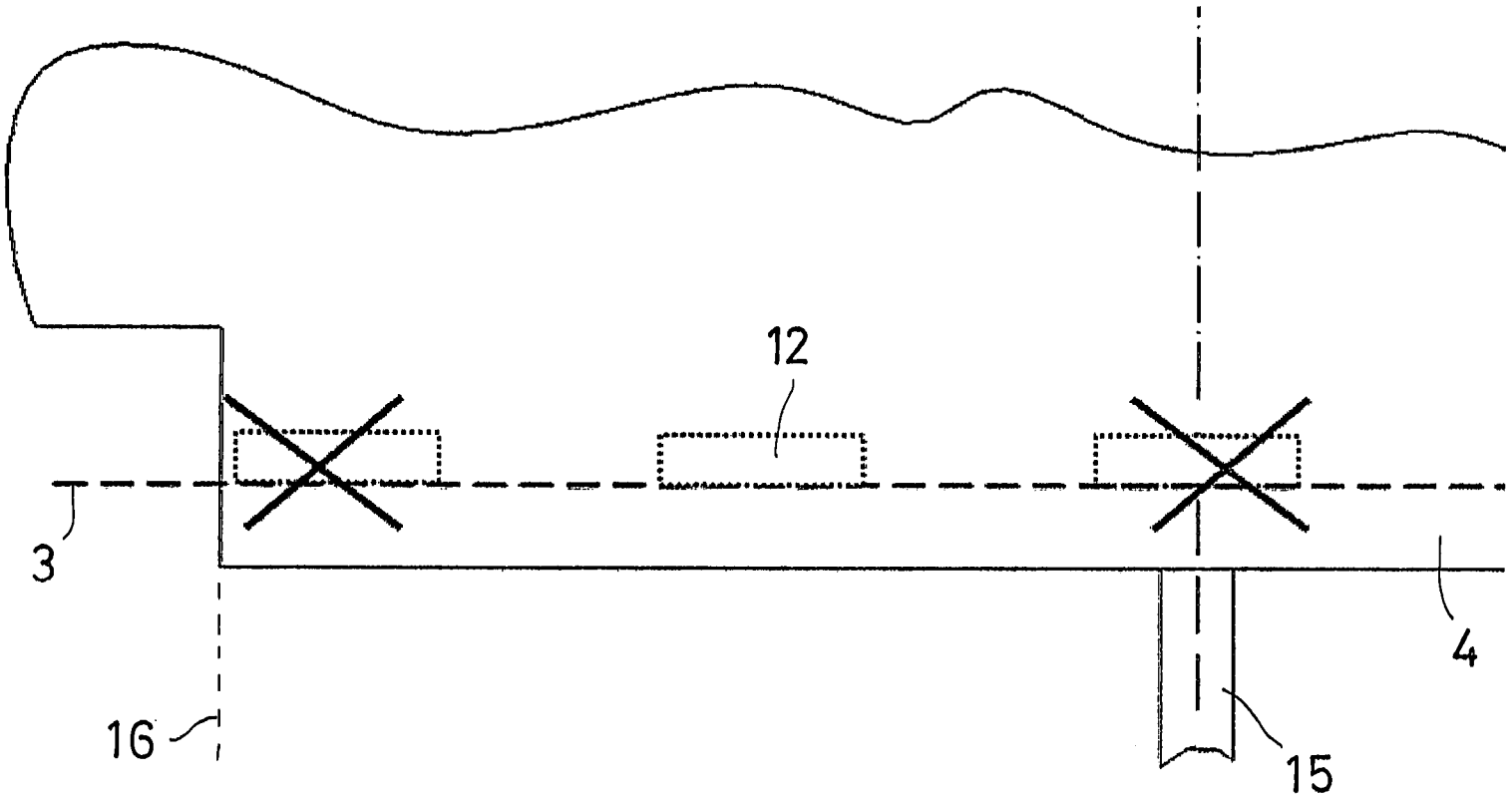
FIG. 3 is a schematic cross section through a part of a tool according to the present invention illustrating the positioning of an accommodation space.

FIG. 3 illustrates a partial section through an elongate steel component 17, where an ingate or sprue 15 enters from beneath into the first mould cavity section 4. In FIG. 3, there is shown at the broken line 16 that part of the steel component which is most distally located in relation to the ingate 15. An accommodation space with connecting duct 12 should be positioned approximately centrally of the ingate 15 and the broken line 16. In the figure, unsuitable positions for such a connection duct 12 have been marked by a cross. In the right-hand part of the tool, not shown in FIG. 3, there may an additional connection duct 12 and an associated accommodation space.

Figure 5:
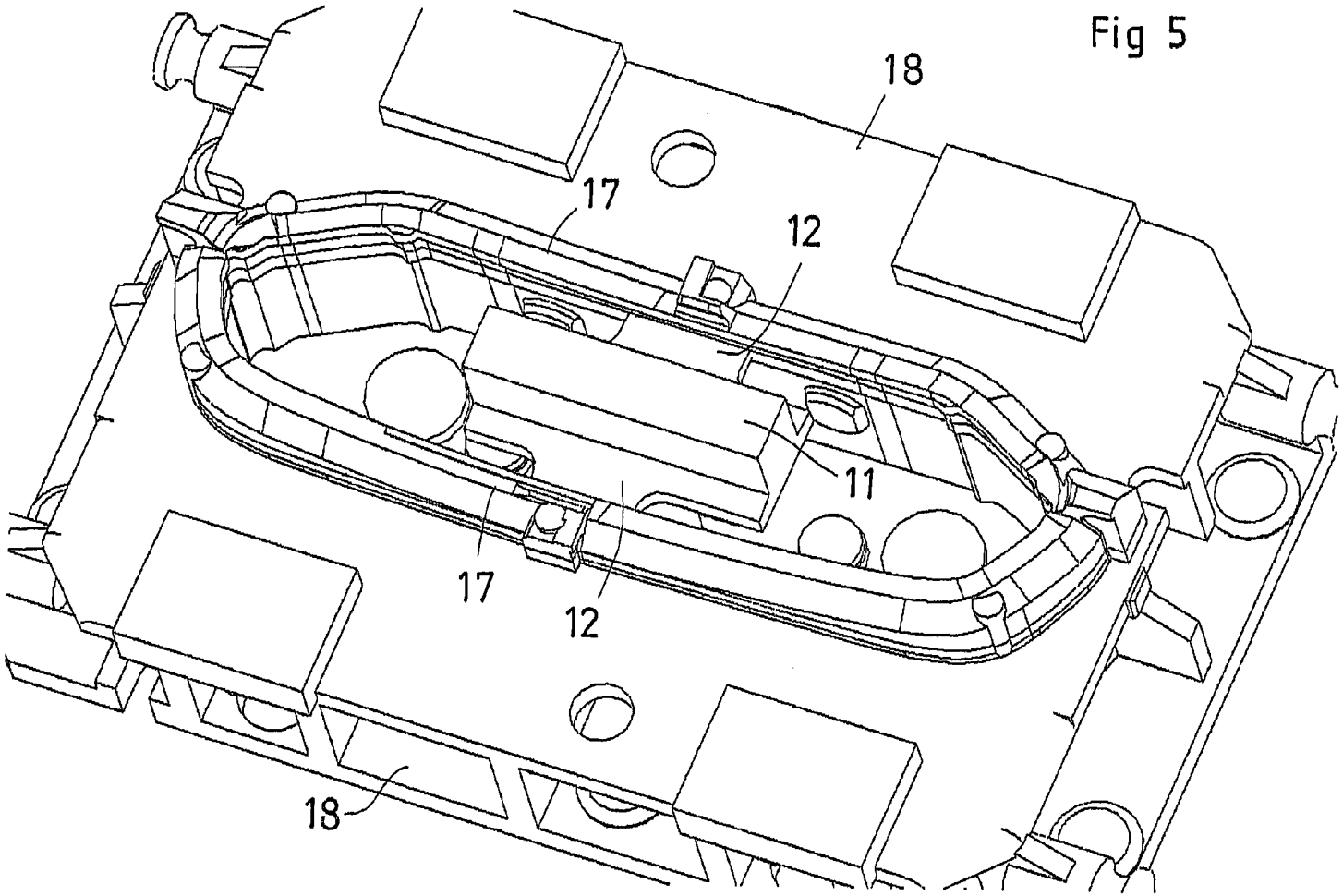
FIG. 5 is a partial view obliquely from beneath (in the casting position) of a tool component suitable for manufacture according to the present invention.

FIG. 5 shows in perspective a tool component obliquely from beneath (in relation to the position the tool component has on its casting). The tool component comprises an elongate, annular steel component 17 or working component and a grey iron component 18 formed as a body component for the tool. With a steel component 17 formed in this manner, a single common accommodation space 11 may be employed for both of the elongate side parts of the steel component 17. This accommodation space 11 has two connecting ducts 12 which connect the accommodation space 11 approximately at the centre of both of the longitudinal sides of the steel component 17.

Figure 6:
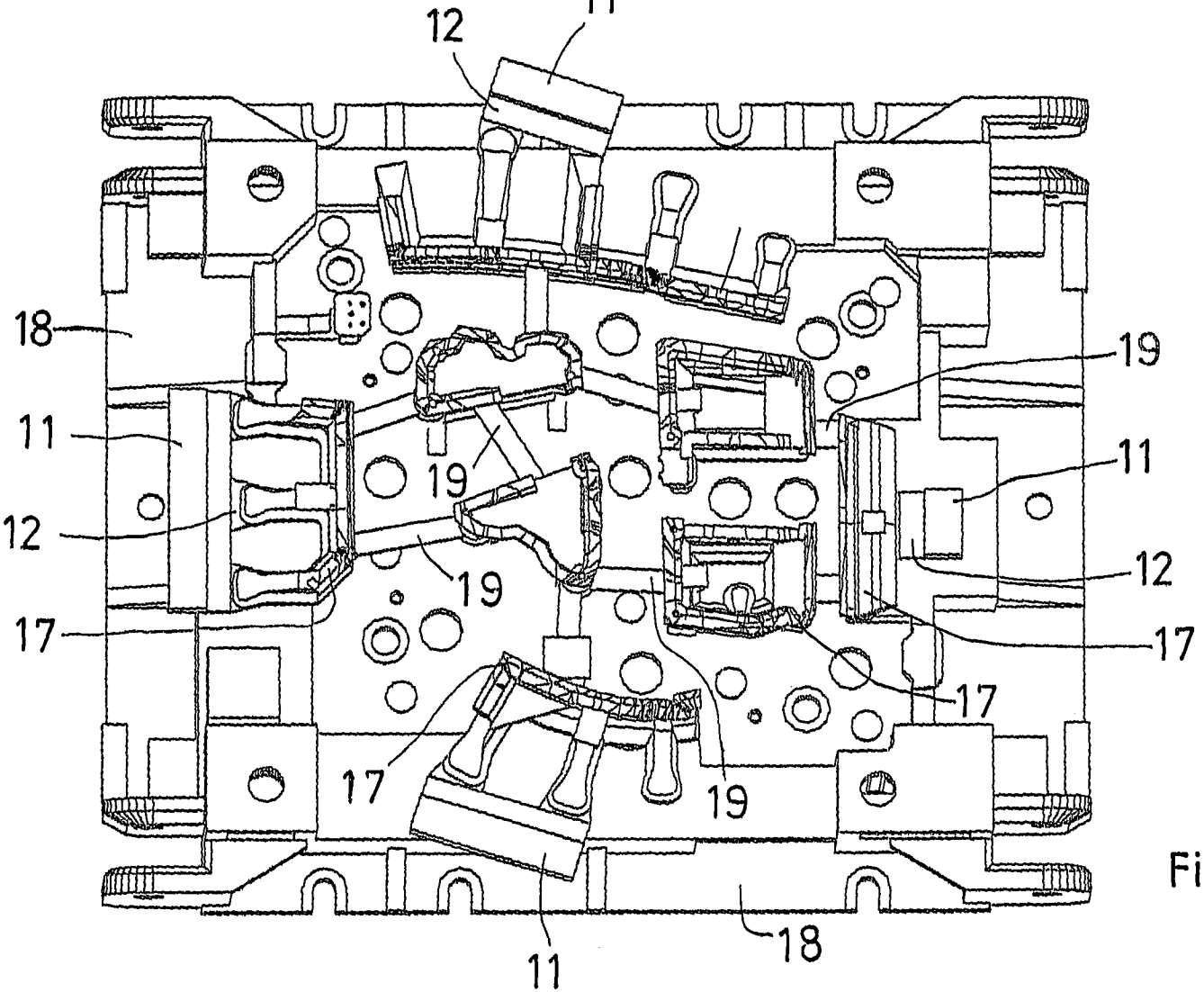
FIG. 6 is a view from beneath of an alternative tool component suitable for manufacture according to the present invention.

FIG. 6 shows a tool component from beneath (in relation to that position it has on its casting). This tool component has a grey iron component 18 and eight steel components 17. These steel components are mutually connected to one another by the intermediary of a number of connecting ducts, whereby the feature will be achieved that a fewer number of ingates may be employed than the number of steel components 17. It is apparent also in the right-hand part of the figure that three steel components 17 may have a common accommodation space 11. It is further apparent that two steel components 17 disposed in the centre of the tool component can, via the connecting ducts 19, utilise the accommodation spaces 11 located furthest upwards and downwards in the figure. In the figure, it is only the steel component 17 located furthest to the left which is connected to its own accommodation space. By connecting, in this manner, connecting ducts 19 to a plurality of steel components 17 entails that a fewer number of accommodation spaces 11 may be employed and that the ingate system may moreover be simplified.

What is claimed is:

1. A mould for composite casting of a one piece cast tool, which comprises at least a first portion which defines a working component of the tool and which is manufactured from steel, and a second portion which defines a body component of the tool and which is manufactured from grey iron, the mould comprising at least one first mould cavity section for the steel and a second mould cavity section for the grey iron, and the tool having at least one interconnection zone between the steel and the grey iron, wherein a dividing plane between the at least one first mould cavity section and the second mould section is substantially planar and, in a position of use of the mould, substantially horizontal and located at an intended position of the interconnection zone, and at least one duct leading from the at least one first mould cavity section to at least one accommodation space for any possible surplus of steel, a lowermost defining surface of the duct at a discharge of the duct to the at least one first mould cavity section being located in a vertical direction on a same level as the dividing plane , wherein the duct is disposed in the at least one first mould cavity section in a central region between an ingate to the at least one first mould cavity section and a portion of the at least one first mould cavity section located most distally from the ingate.

2. The mould as claimed in claim 1, wherein the lowermost defining surface of the duct, in the position of use of the moulding tool, slants downwards in a direction towards the accommodation space.

3. The mould as claimed in claim 1, wherein the duct has a least cross sectional area which exceeds a cross sectional area of the ingate to the at least one first mould cavity section.

4. The mould as claimed in claim 1, wherein more than one duct is present, the more than one ducts having a total least cross sectional area which exceeds a cross sectional area of the ingate.

5. The mould as claimed in claim 1, wherein the accommodation space is interconnected with the at least one first mould cavity section via two or more ducts.

6. The mould as claimed in claim 1, wherein two or more first mould cavity sections are connected to an accommodation space each via at least one duct.

7. A method of composite casting of a one piece cast tool, which comprises at least a first portion which defines a working component of the tool and which is manufactured from steel, and a second portion which defines a body component of the tool and which is manufactured from grey iron, comprising casting the first portion in at least one first mould cavity section and the second portion in a second mould cavity portion in a mould, positioning a substantially planar dividing plane between the at least one first mould cavity section and the second mould cavity section to he substantially horizontal, permitting surplus steel to flow into at least one accommodation space provided in the mould from the at least one first mould cavity section at the level of the dividing plane into the accommodation space through a duct disposed in the at least one first mould cavity section in a central region between an ingate to the at least one first mould cavity section and a portion of the at least one first mould cavity section located most distally from the ingate, a lowermost defining surface of the duct at a discharge of the duct to the at least one first mould cavity section being located in a vertical direction on a same level as the dividing plane.

* * * * *